US009359701B2

(12) United States Patent
Hiatt et al.

(10) Patent No.: US 9,359,701 B2
(45) Date of Patent: Jun. 7, 2016

(54) CONTOURED NEEDLE SUPPORT DEVICE

(71) Applicants: June Hemmons Hiatt, Berkeley, CA (US); Jesse Hiatt, Seattle, WA (US)

(72) Inventors: June Hemmons Hiatt, Berkeley, CA (US); Jesse Hiatt, Seattle, WA (US)

( * ) Notice: Subject to any disclaimer, the term of this patent is extended or adjusted under 35 U.S.C. 154(b) by 0 days.

(21) Appl. No.: 14/571,229

(22) Filed: Dec. 15, 2014

(65) Prior Publication Data

US 2015/0167211 A1 Jun. 18, 2015

Related U.S. Application Data

(60) Provisional application No. 61/916,558, filed on Dec. 16, 2013.

(51) Int. Cl.

| | |
|---|---|
| ***D04B 3/02*** | (2006.01) |
| *D04B 3/00* | (2006.01) |
| *D04B 33/00* | (2006.01) |

(52) U.S. Cl.

CPC ... *D04B 3/02* (2013.01); *D04B 3/00* (2013.01); *D04B 33/00* (2013.01); *Y10T 29/49826* (2015.01)

(58) Field of Classification Search

CPC ..... D04B 3/00; D04B 3/02; D04B 3/06; D04B 35/02; D04B 33/00; D04B 17/04

USPC ..... 66/1 A, 117, 118, 1 R; 224/267, 219, 224/221, 222, 660–684; 2/321, 235

See application file for complete search history.

(56) References Cited

U.S. PATENT DOCUMENTS

| | | | | | |
|---|---|---|---|---|---|
| 1,827,607 | A | * | 10/1931 | Pfaffinger | 24/3.2 |
| 2,058,340 | A | * | 10/1936 | Miller | 223/109 R |
| 2,067,537 | A | * | 1/1937 | Kost et al. | 223/109 R |
| 2,220,633 | A | * | 11/1940 | Albino | 224/673 |
| 2,304,501 | A | * | 12/1942 | Hommer | 242/137.1 |
| 2,461,816 | A | * | 2/1949 | Giovanini | 224/242 |
| 2,540,383 | A | * | 2/1951 | Tillert et al. | 28/149 |
| 3,084,788 | A | * | 4/1963 | Ford | 206/383 |
| 3,346,152 | A | * | 10/1967 | Geisendorff | 224/679 |
| 4,045,061 | A | * | 8/1977 | Fierro | 289/16.5 |
| 4,569,465 | A | * | 2/1986 | O'Farrell | 224/660 |
| 4,866,953 | A | * | 9/1989 | Slevin | 66/1 A |
| 4,911,345 | A | * | 3/1990 | James et al. | 224/149 |
| 5,181,637 | A | * | 1/1993 | Santilli | 224/196 |
| 6,449,987 | B1 | * | 9/2002 | Poole | 66/1 A |

(Continued)

OTHER PUBLICATIONS

Hemmons Hiatt, June. "Knitting Methods." The Principles of Knitting: Methods and Techniques of Hand Knitting. Revised Edition ed. New York City: Touchstone, 1988. 10-13.*

(Continued)

*Primary Examiner* — Danny Worrell
*Assistant Examiner* — James Heracklis
(74) *Attorney, Agent, or Firm* — Dorsey & Whitney LLP

(57) ABSTRACT

The present disclosure is related to a wearable knitting needle support device. The wearable needle support or knitting pad includes an anchoring filling configured to support a needle in a desired position, a needle reception area with apertures on all or parts of the surface that covers the anchoring filling, and a contoured substrate opposite of the needle reception surface. The contoured substrate is concavely curved along at least one axis and serves to produce an identical curve in the lower piece 116. The knitting pad may be connected to a belt or other attachment mechanism that secures the pad to a select position on a user.

21 Claims, 4 Drawing Sheets

(56) References Cited

U.S. PATENT DOCUMENTS

| | | | | |
|---|---|---|---|---|
| 6,513,224 | B1 * | 2/2003 | Chen et al. | 29/469 |
| 8,517,233 | B2 * | 8/2013 | Podda-Heubach | 224/183 |
| 8,746,753 | B2 * | 6/2014 | Crorey | 289/13 |
| 2005/0017042 | A1 * | 1/2005 | Friou | 224/660 |
| 2007/0095870 | A1 * | 5/2007 | Griffith et al. | 224/219 |
| 2007/0284405 | A1 * | 12/2007 | Prevost | 224/682 |
| 2008/0208149 | A1 * | 8/2008 | Vasquez | 604/322 |
| 2009/0218245 | A1 * | 9/2009 | Arnoff | 206/392 |
| 2010/0050697 | A1 * | 3/2010 | Barry | 66/1 A |
| 2011/0210571 | A1 * | 9/2011 | Dan | 294/1.3 |
| 2013/0145518 | A1 * | 6/2013 | Decet | 2/171.2 |
| 2015/0167211 | A1 * | 6/2015 | Hiatt et al. | |

OTHER PUBLICATIONS

"Knitting Belts." Knitting Belts. HazelTindall.com, Apr. 11, 2013. Web. Jul. 6, 2015.*

"Knitting Sheaths & Belts." Knitting Belts, Sheaths, Sticks, Wisps. Old&Interesting.com, Nov. 27, 2009. Web. Jul. 6, 2015.*

* cited by examiner

CONTOURED NEEDLE SUPPORT DEVICE

CROSS-REFERENCE TO RELATED APPLICATIONS

This application claims priority to U.S. Provisional Application No. 61/916,558, entitled "Contoured Pad for Knitting Needle Support," and filed Dec. 16, 2013, which is hereby incorporated by reference in the entirety herein.

FIELD

The present invention relates generally to tools for hand knitting and, more specifically, to a device for supporting one of the needles during hand knitting.

BACKGROUND

The present disclosure generally relates to tools for hand knitting. To allow a better understanding of how knitting tools, such as the ones described, can be used, a basic instruction of hand knitting is provided below.

For flat fabrics, two knitting needles are employed. To begin, one needle bearing a set of stitches of any number is normally held in the left hand, and an empty needle is held in the right hand. Then, the tips of the two needles are brought together and used to manipulate each stitch in turn, as necessary, to draw a small amount of a continuous yarn supply through it in order to form a new stitch. The new stitch is mounted on the right needle and the original stitch is dropped from the left needle, where it then lies below the original stitch and forms part of the growing fabric. When the original set of stitches on the left needle have all been worked, that needle will be empty and a new set of stitches will be on the right needle. The two needles are then exchanged from one hand to the other, and the process is repeated.

For circular fabrics, three or more needles are used, each one bearing a portion of the stitches. The needles are drawn into a circle and the work progresses continuously from one needle to the next clockwise with the stitches manipulated as described above. The needle bearing a new set of stitches is set down to the right, the empty needle is transferred from left hand to right, and the next needle to the left is taken up and the stitches on it are then worked in the same way.

Hand knitters have traditionally employed various devices to support one of the needles while knitting, thereby facilitating the speed and ease with which the work is done. These devices function as the equivalent of a "third hand" or "helping hand," and hold an object as it is being worked on, freeing the hands to manipulate materials and/or tools for tasks, such as electronic parts assembly and/or craftwork.

Historical evidence suggests that hand knitters in Europe (and most likely elsewhere) have used devices of this kind to support a knitting needle for a very long time. Several different types were traditional in various regions, and were usually hand made by a family member or someone in the community. More recently, several patents have been issued for devices intended to serve somewhat the same purpose. These are discussed below.

Two of the earliest and simplest devices used as knitting needle supports are the knitting wisp and the knitting quill. These devices were typically made up of no more than a handful of straw or goose quills, tightly bound together in a cone shape by means of string or yarn, often woven in a decorative pattern. The bound end of the bundle was tucked into the knitter's waistband or apron string, and one tip of a knitting needle was inserted into the free ends of the straw or the vanes of the feathers, where it was held in position.

Another device that was traditionally used is variously called a knitting stick or a knitting sheath. This is essentially a more refined version of the wisp or quill described above, and is also worn at the waist. Typically, a knitting stick is a narrow object made of wood, bone, or metal, about 4-8" long, either round or square in cross-section or in the shape of a cone, with a hole in one end for the knitting needle. Many of these sticks were elaborately carved or etched and can be seen in museum displays of traditional craft tools.

A more sophisticated device is the knitting belt, which is an oval leather pad, generally about 8-9" long and 2-3" at its widest, firmly stuffed with horsehair, and having several holes punched in the top. A belt is attached to each end of the pad, allowing it to be fastened to the knitter's right side at waist or hip. A knitting needle is inserted into one of the holes in the pad where it is held in a fixed position by the horsehair stuffing.

More recently, some novel knitting devices have been patented. U.S. Pat. No. 2,461,816 appears to disclose a device that resembles the traditional knitting stick. It is a wood tube attached to a belt and worn at the waist. The end of the tube has several holes of different sizes with an adjustable clamp inside. A knitting needle is inserted into one of the holes and the clamp holds it in position. While this device could be used as an alternative to a knitting belt, both its construction and mode of use are sufficiently different that it is not relevant to the features of the knitting device disclosed herein.

U.S. Pat. No. 4,866,953 appears to disclose a device that holds two knitting needles by means of a pair of rectangular, notched holders attached at each end of a strap that the knitter either sits on, or places on the lap, with one holder at each side. Special needles with a unique ball-joint head are inserted into one of the notches in the holder. While purportedly for a similar purpose, this device is different from the invention described here in both its construction and mode of use.

U.S. Pat. No. 6,449,987 appears to disclose a wooden device that is clamped to a table or other surface, having an adjustable bar with notches to hold a knitting needle. It is intended as an aid for disabled knitters who have the use of only one hand. Both the construction of this device and its mode of use are sufficiently different from the one described here, and is not relevant to the claims made.

Both knitting sticks and knitting belts gradually fell out of favor and are no longer in common use for a number of reasons, as discussed below. Currently, while information about these devices is available on the Internet and from other sources, and authentic examples made by individual artisans can still be obtained, these tools are now primarily thought of as no more than curiosities. Modern knitters have never seen these devices, and, if they do know of them, are unfamiliar with how they are used.

The gradual decline in the use of these devices appears to be due to certain characteristics of these traditional designs, which came to be seen as inconvenient or uncomfortable by those not accustomed to using them.

In particular, with respect to knitting sticks, the size of the opening in the end accommodates needles of only one or two sizes. This was not seen as a problem in the past because traditional knitters had a very limited number of needle sizes available to them. However, contemporary knitters work with a wide range of sizes; therefore, if a knitter wished to use a knitting stick, several of them would be required, each with a different-sized opening.

Additionally, the waistband determines the location of the device and the angle of the needle, and these factors determine the position of the knitter's hands and arms. As a result, the needle may not be in the optimum position for comfort or viewing the work at the best distance. Further, contemporary knitters do not always wear clothing with a waistband tight enough to hold a knitting stick in position, or may wear a garment that has no waistband, although it is possible to wear a separate belt to hold the stick in position.

A conventional knitting belt is a somewhat more versatile device than a knitting stick because it can be used with needles in a wider range of sizes and can be worn in a more convenient position, as shown in FIG. 1.

However, because the pad is firmly stuffed with horsehair, both the top and the bottom have a rounded, pillow-like shape, which means the bottom curves up, away from the body in wear. As a result, the pad has a tendency to rock both horizontally and vertically when subjected to the motions used in knitting. This has several deleterious effects, as detailed below.

One, as each stitch is manipulated, downward pressure is placed on the needle tip and this force is transferred to the pad. Due to the rounded shape of the bottom piece, the pad tends to rock up and down vertically as this pressure is applied and released. This requires the knitter to use a slightly greater range of motion, reducing speed and efficiency. Two, the pad is subjected to a certain amount of force every time a needle is inserted into or removed from the pad, causing it to rock back and forth horizontally and gradually shift position. Because the position of the pad may change due to the forces exerted on it during the course of knitting, the knitter may be required to stop from time to time to readjust it, which tends to slow down the overall progress of the work.

While the design of these devices is less than ideal in some respects, they function adequately for the purpose and suit the needs of the traditional knitters who are accustomed to them. As a result, they have remained basically unchanged for a very long time, except for minor differences in decorative details, materials, and size.

SUMMARY

One embodiment of the present disclosure is a wearable needle support. The wearable needle support may include an anchoring filling configured to support a needle in a desired position, a needle reception surface at least partially covering the anchoring filling, and a contoured substrate opposite of the needle reception surface permanently connected to the needle reception surface. The contoured substrate is concavely curved along at least one axis.

Another embodiment of the present disclosure is a method of making a knitting accessory. The method includes forming a shapeable material from an initial shape into a contoured shape, attaching an outer material to the shapeable material to define a cavity between the shapeable material and the outer material, and stuffing an anchoring material in to the cavity.

Yet another embodiment of the present disclosure is a support device for knitting connectable to a body of a user. The support device includes a needle support member and a stability component connected to the needle support member. The stability component is concavely shaped to match a portion of the body of the user where the support accessory is connected. For example, when connected to a user's waist or abdomen the stability component may be concavely shaped to follow the shape of the waist or abdomen.

SPECIFICATION

Overview

Figure 1:
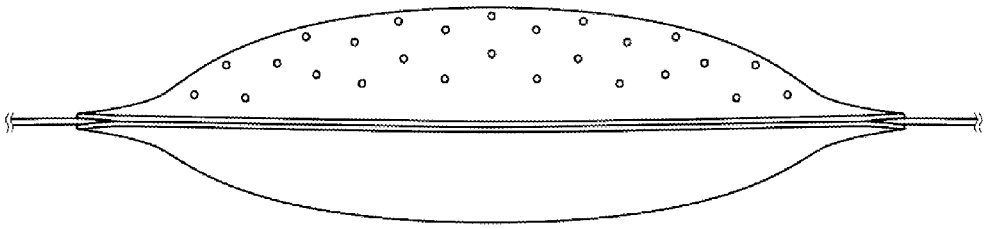
FIG. 1 (PRIOR ART)
FIG. 1 is a top plan view of a traditional knitting belt.

The present disclosure relates generally to a wearable knitting device that supports one of the needles during the process of hand knitting. In one example, the knitting device is an oval or other oblong-shaped pad with a belt attached at each longitudinal end, allowing the device to be worn on a user's body, typically near or at the right side of the waist or hip. The belt may be removably attachable to the knitting device or may be formed integrally or otherwise permanently secured to the knitting device. In examples where the belt is permanently secured to the knitting device, the belt would have some mechanism, e.g., fastener, holes, or the like, for adjusting the size to fit the knitter. In examples where the belt is removably attached, the user can change the belt as desired or needed, e.g., to accommodate fluctuations in body weight, to vary the position of the device during use, or the like.

The bottom of the pad is contoured and permanently stiffened so as to fit the body and remain in a stable position while in use. In particular, the pad may include a contoured member or substrate that determines the shape or topography of the back surface of the pad. The contoured member is shaped so as to conform to the shape of a user's body, e.g., concavely curved to match the shape of a user's midsection. As will be described in more detail below, the contoured shape helps to secure the pad in position and prevent movement during knitting. This makes the knitting pad more efficient easier to use, and expedites the knitting process. In one example, the contoured member is a separate component that is inserted into and permanently attached to the material forming the pad. In particular, the contoured member may be made of material such as a thermoformable plastic that can be heated, formed into a desired shape, and then cooled to retain the formed shape. In other embodiments, the contoured member may be formed integrally with the pad. In these embodiments, the shape of the contour may be tailored as desired, e.g., to match the dimensions of a particular user, or the like. In embodiments where the contoured member is removable from the pad, the user can vary the shape of the back surface of the pad by interchanging the contoured members The following is redundant with above.

The pad may also include one or more needle insertion apertures configured to receive several different needle sizes. For example, in one embodiment, the top left of the pad has several holes pierced in it, each of which are large enough to allow for the insertion of one tip of a double-point knitting needle (e.g., a needle having identical pointed tips at both ends). The number, size, and location of the various needle insertion apertures may be varied as desired, based on the type of needles to be used, as well as user preferences. In other embodiments, the outer material on the front side of the pad may be an expandable, pre-perforated material that allows the needles to be inserted into the outer surface, without a defined needle aperture needing to be formed separately.

The pad may be filled or stuffed with a filling, anchoring material, or needle support substance that allows the needle to enter the interior of the pad and holds the needle in a fixed position at an angle selected by the knitter. The needle support material may be substantially any type of material that is sufficient to grip and secure a needle in a desired orientation, while also allowing the needle to be inserted, at least partially, through the material. For example, the anchoring material may be horsehair, other hair-like substances, oriented strands or beads, or the like. In examples where beads are used, continuous oriented strands of beads may be tangled or knotted together, similar to tangled horsehair, or may be coiled and inserted at a right angle to the length of the pad.

DETAILED DESCRIPTION

Figure 2:
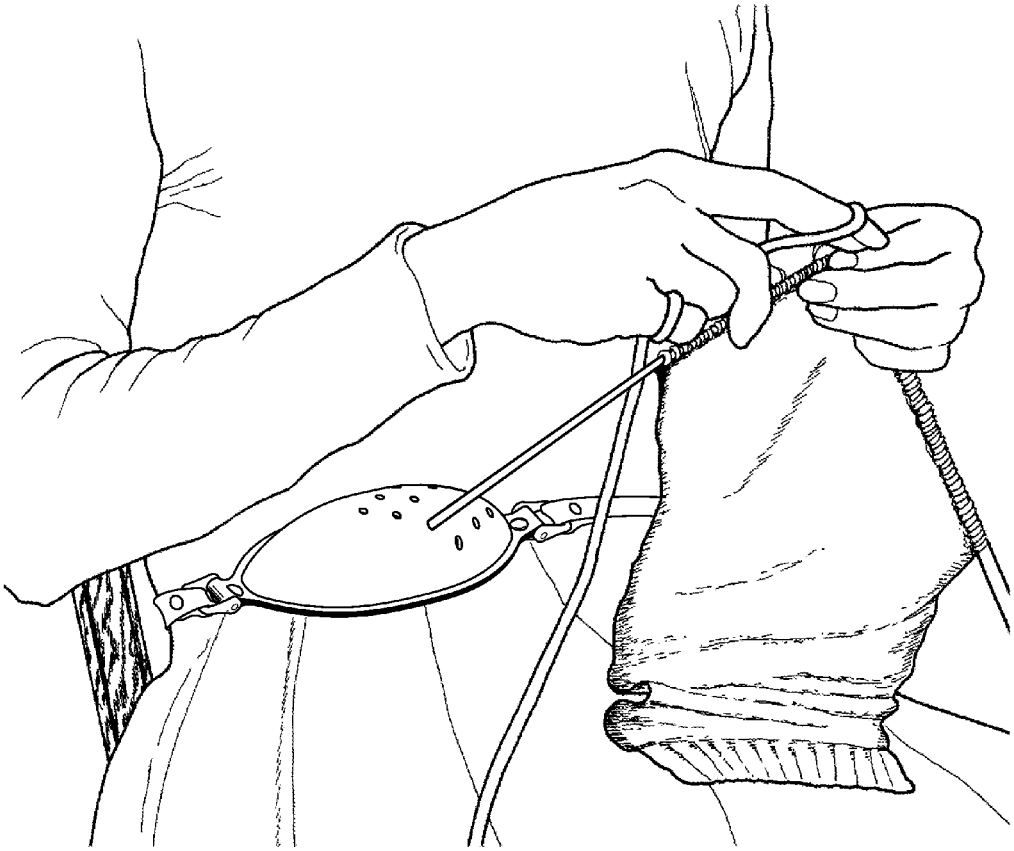
FIG. 2 is an isometric view of a knitting support device connected to a user.
Figure 3:
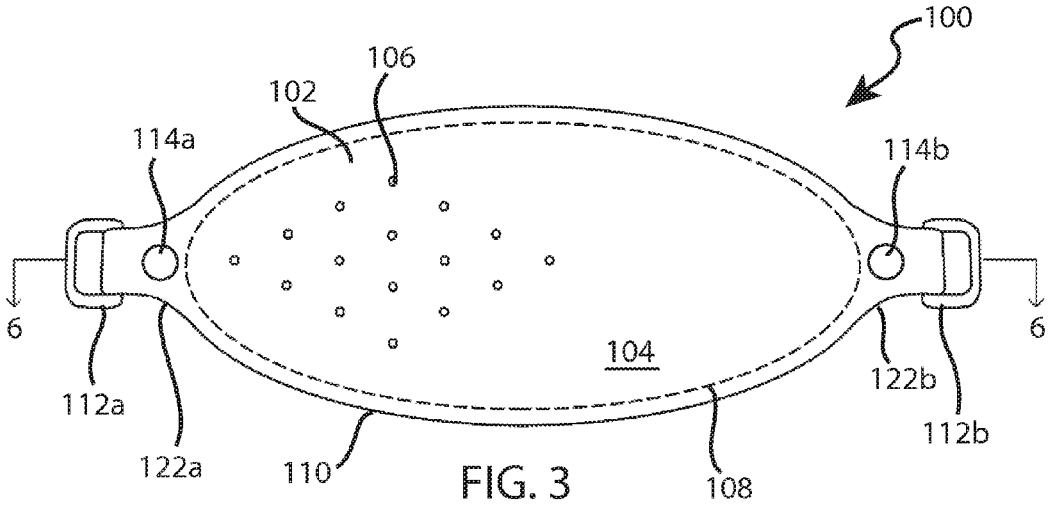
FIG. 3 is a front elevation view of a knitting support device.
Figure 4:
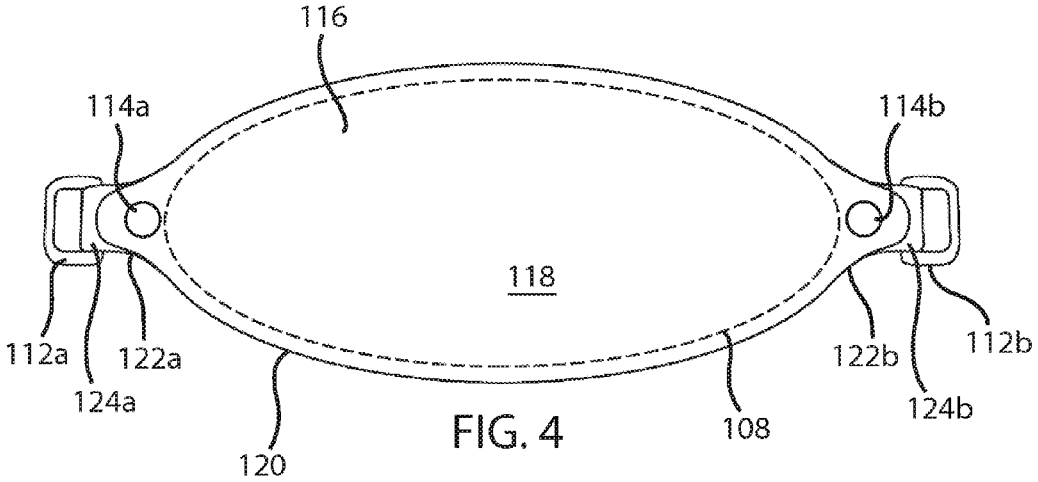
FIG. 4 is a rear elevation view of the knitting support device of FIG. 3.

Turning to the figures, the knitting pad 100 will now be discussed in more detail. FIG. 2 is an isometric view of a user wearing the knitting pad 100 on a belt 101 during use. FIGS. 3-7 are various views of the knitting pad 100. With reference to FIGS. 2-7, the knitting pad 100 may generally include a top component 102 and a bottom component 116 that are connected together to define an interior cavity 136 for receiving an anchoring filling and a contoured substrate 130. The knitting pad 100 may also include two or more belt connectors 112*a*, 112*b* and one or more fasteners 114*a*, 114*b* that secure the belt connectors 112*a*, 112*b* to the knitting pad 100. With reference to FIGS. 2 and 3, the pad 100 may be joined to a belt 101 at each narrow end 122*a*, 122*b* allowing the pad 100 to be worn by a knitter at a desired location on the user's body, such as on the left or right side of the waist or hip.

In one embodiment, the knitting pad 100 may have an oval shape configured to be oriented horizontally such that a longitudinal length of the pad 100 extending from a first end 122*a* to a second end 122*b* may be arranged laterally across the waist of a user. However, it should be noted that other shapes and orientations may be used. Additionally, as will be discussed in more detail below, the bottom surface 118 of the knitting pad 100 may be concavely curved whereas the top surface 104 may be convexly curved. In this manner, the top surface 104 may bow out to form a dome-like shape and the bottom surface 118 may bow inwards. The shape of the knitting pad 100 and, in particular the bottom surface 118, helps to maintain the knitting pad 100 in a selected orientation and position when secured to the user. The shape of the top surface 104 is bowed to allow sufficient depth to the interior and to provide space for adequate stuffing to hold a needle securely. This exterior convex shape also allows the holes to be oriented in the direction that a needle will be inserted and held at the desired angle.

The components for the knitting pad 100 will each be discussed, in turn, below. With reference to FIGS. 3 and 6-8, the top component 102 will now be discussed in more detail. The top component 102 forms the top surface 104, or needle reception surface 104, for the knitting pad 100 and defines a top outer edge 110 of the knitting pad 100. The top component 102 may be made of substantially any type of suitable material. In one embodiment, the top component 102 is made of American Bison leather or bovine bullhide. In these embodiments, the leathers were selected because they are durable and strong enough to contain the anchoring material (discussed in more detail below) and generally are impervious to being accidentally scratched or pierced by the sharp point of a knitting needle while the pad 100 is in use. Other types of materials for the top component 102 include other types of leather, artificial leather or leather-like materials, reinforced fabrics, or any other durable material or combination of materials having similar functional properties.

The top component 102 may be shaped based on a desired shape of the knitting pad 100. For example, in the embodiments shown in FIGS. 2-8, the top component 102 may have a general oval shape defining the shape of the knitting pad 100. Additionally, the top component 102 may have a convex curvature so the needle reception surface 104 forms a dome shape structure. In some embodiments, the top component 102 may be formed into a pre-determined shape, such as the convex-shaped structure, and may be sufficiently rigid so as to retain the shape when the anchoring filling 132 or stuffing is removed. For example, in one embodiment, the top component 102 may be permanently shaped by being soaked in water and pressed into a mold so it will retain its contour once the material has dried. This feature helps to prevent the anchoring filling 132 from over-compressing. Other methods for forming the top component 102 into a desired shape may also be used. In particular, depending on the material, soaking in water or another liquid may not be necessary. For example, a plastic or closed cell resin such as Croslite (used for CROCS) may be used in which case the material may be heat formed and stamped or extruded into a mold.

Additionally it should be noted that in some embodiments, the convexly curved top surface 104 may have a shape other than a smooth convex dome. For instance, it could be shaped, by forming, stitching, or any other means, with the curve having a higher angle on one side in order to orient the holes so they face more directly toward the direction in which a needle will be inserted.

Figure 7:
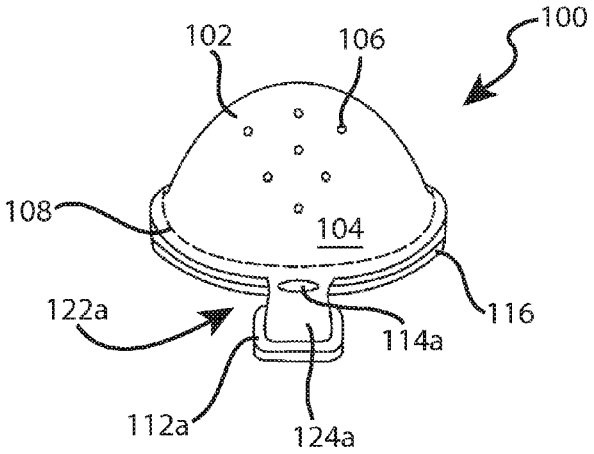
FIG. 7 is a right side view of the knitting support device.
Figure 8:
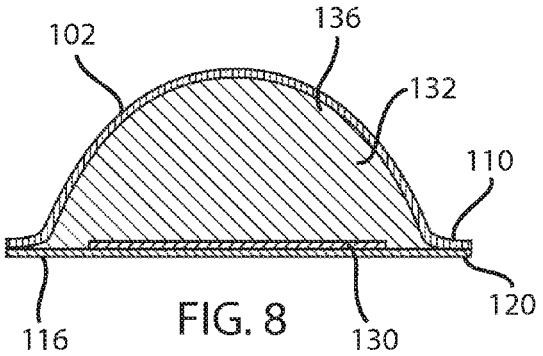
FIG. 8 is a cross-section view of the knitting support device taken along line 8-8.

With reference to FIGS. 3, 7, and 8, the top component 102 may include a plurality of needle reception apertures 106. These apertures or pores 106 extend through the top component 102. The needle reception apertures 106 may be positioned substantially anywhere along the needle reception surface 104, but in some embodiments the needle reception apertures 106 may be arranged towards a first end 122*a* of the needle reception surface 104. The needle reception apertures 106 may also be clustered together or separated from one another, or may cover the entire surface of the top component. The orientation of the needle reception apertures 106 may be arranged to form an aesthetically pleasing design or the like. For example, as shown in FIG. 3, the needle reception apertures 106 may be arranged in a diamond-like shape.

In one embodiment, the needle reception apertures 106 are positioned on the left side of the top piece of the pad 100 so a needle inserted into the interior of the pad 100 will be angled toward the center of the user's body, which will assist the user during the knitting process and provide a more ergonomic and comfortable knitting orientation. Multiple needle reception apertures 106 may be included to allow different users to position the needle within the pad 100 in a desired position and to allow the user to dynamically adjust the position of the needle while using the pad 100.

To form the needle reception apertures 106, the top component 102 of the pad 100 may be pierced by a tool. The needle reception apertures 106 may have a size and shape to accommodate typical diameter sizes of the shaft of the various knitting needles commonly used. The shape, size, and position of the needle reception apertures 106 may be selected based on the types of needles to be used, the types of knitting to be done, preferences of the user, and the like.

Additionally, the needle reception apertures 106 may have varying diameters and/or shapes so as to accommodate different types of needles within the same pad 100. Additionally, the needle apertures may be formed by metal grommets that are permanently attached to and pierce the top component to form holes of various pre-determined sizes.

With reference to FIGS. 4-6 and 8, the bottom component 116 will now be discussed in more detail. The bottom component 116 forms a bottom surface 118 and the bottom outer edge 120 of the knitting pad 100. The bottom component 116 may generally match the shape and the dimensions of the top component 102. For example, the bottom component 116 may have an oval or oblong shape that corresponds to the shape of the top component 102. The bottom component 116 may be substantially any type of material, but may not need to be as impervious to scratches or as durable as the top component 102 since the bottom component 116 is oriented towards the user and needles are not inserted into the bottom component 116. In one embodiment, the bottom component 116 is Latigo leather, which is used due to its relative stiffness and because this material can be permanently contoured, in part by shaping the leather itself and in part by applying a permanently contoured substrate 130 to the interior surface 134 of the bottom component 116, as will be discussed in more detail below. However, in other embodiments, the bottom component 116 may be formed of the same material as the top component 102 and/or may be formed of various other types of suitable materials.

Figure 6:
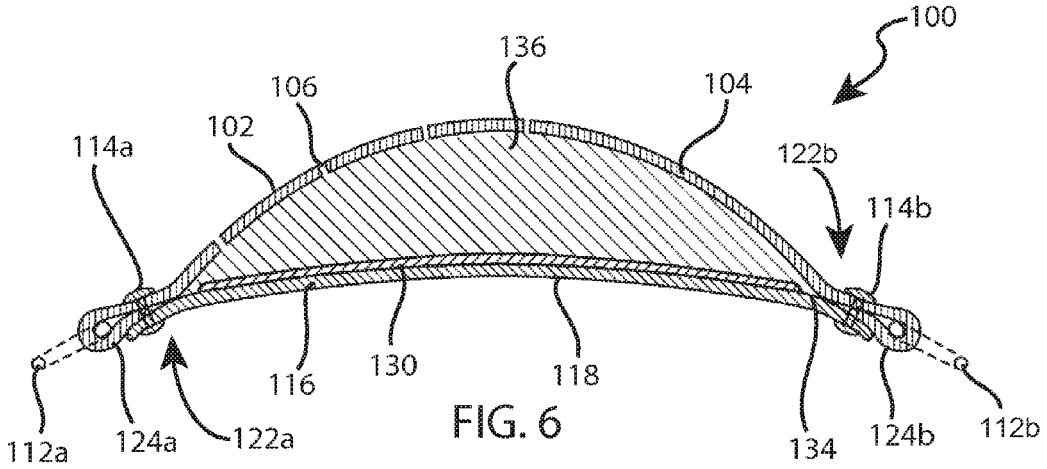
FIG. 6 is a cross-section view of the knitting support device taken along line 6-6 in FIG. 3.

With reference to FIGS. 6 and 8, the knitting pad 100 may also include an anchoring filling 132. The anchoring filling 132, which may be a stuffing or filling material, forms the internal structure of the pad 100. The anchoring filling 132 is inserted into the interior cavity 136 defined between the top component 102 and the bottom component 116. The anchoring filling 132 defines, at least in part, the shape of the needle reception surface 104 of the top component 102 and also acts to anchor needles in the pad 100 and retain the orientation and position of the needle during use.

The anchoring filling 132 may be any suitable material. However, in one embodiment, the anchoring filling 132 used to stuff the pad 100 is natural horsehair, which has unique characteristics suitable for the pad 100. In particular, horsehair is extremely durable, wiry, springy, and tangled, allowing the horsehair to be packed tightly into the interior cavity 136 while still retaining air space and resilience. Further, the horsehair retains this resilience without crushing down or losing volume, and thus holds the shape of the top component 102 of the pad 100 substantially without change throughout its useful life.

In embodiments of the knitting pad 100 where the anchoring filling 132 is horsehair, the material retains air space even when compressed within the pad 100, making it easy to insert a knitting needle of any size into the interior of the anchoring filling 132. The filling 132 compresses slightly more, but there is no change in the overall contour of the top component 102 of the pad 100. Because the individual hairs are tangled together, a needle inserted into its midst cannot move through it laterally, and so will not shift position from the angle given to it upon insertion. In order to change the angle, it is necessary to pull the needle out and reinsert it.

However, it should be noted that the anchoring filling 132 may be other suitable materials having similar characteristics such as, but not limited to, artificial horsehair (most often, but not limited to, polyester), a fine crumpled netting, a continuous tangled string-like material, or any other material or combination of materials that would behave like horsehair, i.e. materials that hold the shape of the pad 100 without compressing over time, allows repeated insertion of the needle without degradation, and maintains the fixed position of the needle at whatever angle was established by the knitter upon insertion.

With continued reference to FIGS. 6 and 8, the contoured substrate 130 will now be discussed in more detail. The contoured substrate 130 is positioned within the interior cavity 136 defined by the top and bottom components 102, 116. The contoured substrate 130 defines the topography or surface shape of the bottom surface 118 of the pad 100. The contoured substrate 130 may be a stiffening piece of material that is formed into a desired shape. The contoured substrate 130 generally may be sufficiently rigid so it holds its formed shape and encourages the bottom component 116 to conform to the shape defined by the contoured substrate 130.

In some embodiments, the contoured substrate 130 defines a stiffening material and is made of a thin heat-formable plastic. As will be discussed in more detail below, in these embodiments, the contoured substrate 130 remains permanently shaped once it has cooled and cannot be deformed except at temperatures well above those found in normal conditions. In other embodiments, the contoured substrate could be formed of metal or plastic, or any other material that could be manufactured with the desired contour and required no additional shaping.

The contoured substrate 130 is shaped to have a concave curve that extends upwards to define a depression. The contour of the substrate 130 is intended to conform to the general shape of the human body at the side front of the waist or abdomen, where the pad 100 is positioned, providing stability while the pad 100 is in use. With continued reference to FIGS. 6 and 8, the contoured substrate 130 may be curved along its longitudinal length or axis but may be relatively straight along its vertical height. The shape, dimensions, and angles of the curvature of the contoured substrate 130 may be varied as desired and may be configured to match the curvature of a particular user, or the like. The curvature and rigidity of the contoured substrate 130 provides enhanced stability and comfort while using the knitting pad 100. As will be discussed in more detail below with respect to FIG. 9, the curvature of the contoured substrate 130 may be defined during a thermoforming process and, once the contoured substrate 130 has been formed into a desired shape, it will remain in the selected shape.

In some embodiments, the knitting pad 100 may have a shorter longitudinal dimension or may be round or nearly so. In this case, the longitudinal curved contour of bottom surface 118 may be substantially negligible due to the shortened arc of the curve, or it could be flat, with stability provided by the permanently stiffened bottom surface 118.

It should be noted that in some embodiments, the contoured member 130 and the bottom component 116 may be integrated together. For example, the bottom component 116 and stiffening piece or contoured substrate 130 may be replaced with a single piece of material permanently shaped into the desired contour and attached to top component 102 to serve as the bottom of the pad 100.

With reference again to FIGS. 2, 5, and 6, the knitting pad 100 may also include one or more belt connectors 112*a*, 112*b*. The belt connectors 112*a*, 112*b* are configured to removably or permanently attach to a belt, or the like, that may be used to attach the knitting pad 100 to a user. The belt connectors 112*a*, 112*b* may be operably connected to the first end 122*a* and the second end 122*b*, respectively, of the knitting pad 100. In one example, the belt connectors 112*a*, 112*b* are D-ring fasteners, but in other embodiments may be substantially any type of link, buckle, fastener, or the like. It should be noted that, in some embodiments, a belt may be permanently or directly attached to the pad 100, and the belt connectors 112*a*, 112*b* may be omitted. For example, the ends of the belt may be riveted, sewn or glued to the ends 122*a*, 122*b* of the pad 100.

In some embodiments, including the belt connectors 112*a*, 112*b*, the belt connectors 112*a*, 112*b* may be attached to one or both of the top and bottom components 102, 116. In one example, the top component 102 may include a tab 124*a*, 124*b* of material formed on each of the ends 122*a*, 122*b*. As shown in FIG. 6, the tabs 124*a*, 124*b* may wrap around a portion of the belt connectors 112*a*, 112*b* and be secured to itself and/or the bottom component 116 by a fastener 114*a*, 114*b* (which may be a rivet, adhesive, or any other fastening component).

Figure 5:
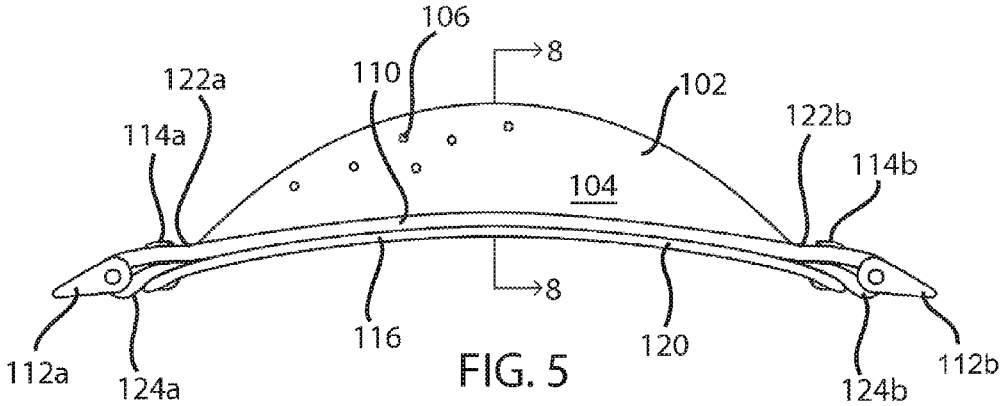
FIG. 5 is a top plan view of the knitting support device of FIG. 3.

As a quick overview of the assembly of the knitting pad 100, with reference to FIGS. 5 and 6, the knitting pad 100 is configured so the top and bottom components 102, 116 are connected together to secure the anchoring filling 132 in the interior cavity 136 formed between the two components 102, 116. The contoured member 130 is secured to the bottom component 116 and defines the shape of the bottom surface 118 of the knitting pad 100. The belt connectors 112*a*, 112*b* may be connected to the ends 122*a*, 122*b* of the pad 100 and are configured to receive a belt, or the like, to attach the pad 100 to the user.

Figure 9:
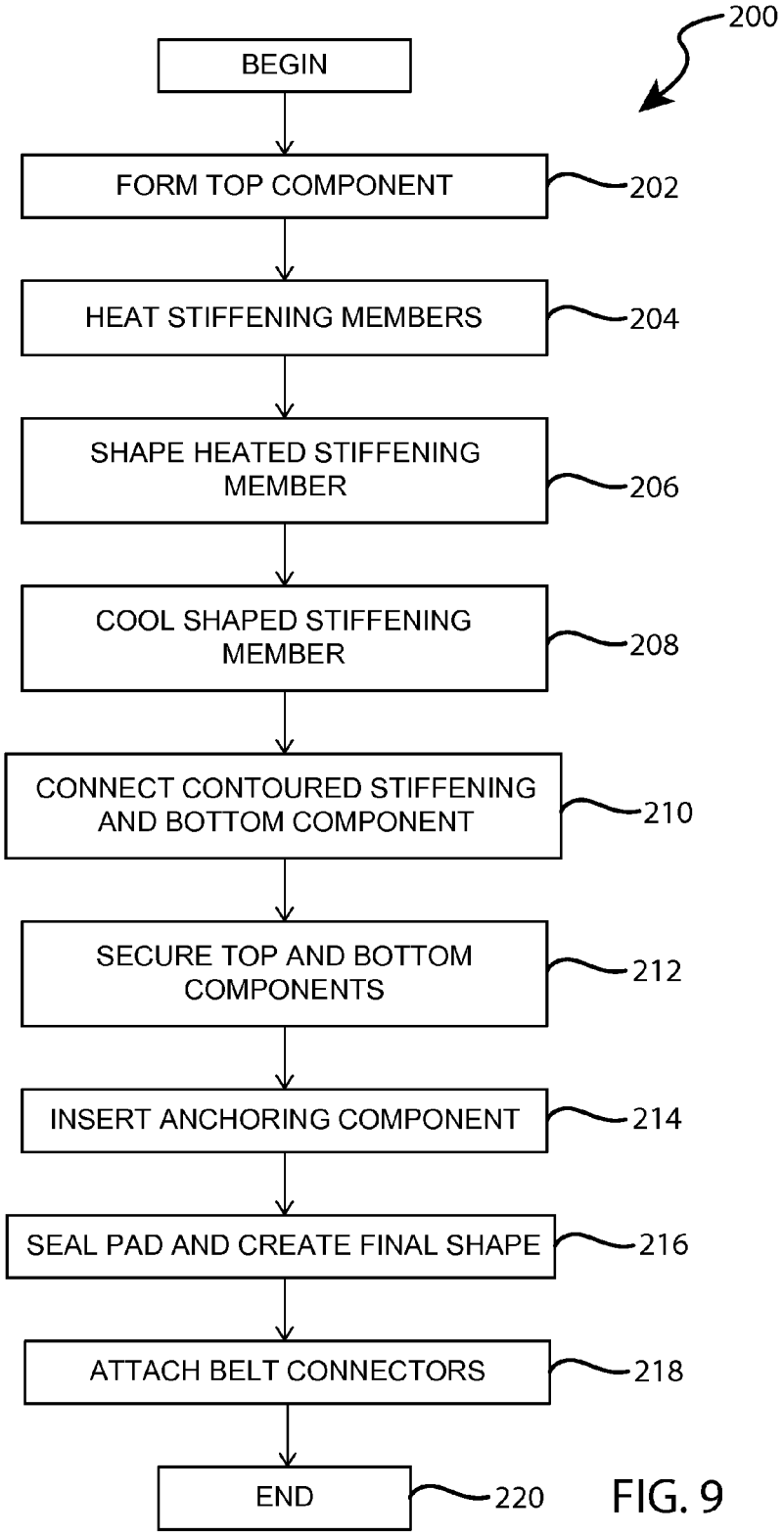
FIG. 9 is a flow chart illustrating a method of making the knitting support device.

A method of assembling and manufacturing the pad 100 will now be discussed in more detail. FIG. 9 is a flow chart illustrating a method for assembling the knitting pad 100. With reference to FIG. 9, the method 200 may begin with operation 202. In operation 202, the top component 102 is formed. In instances where the top component 102 is leather, the top component 102 is soaked in hot water for a sufficient time so as to become pliable and stretchable, e.g., between 40-90 seconds and, preferably, about 60 seconds. Once the top component 102 has been thoroughly warmed and is pliable, the top component 102 is set into a concave portion of a mold, covered with a matching convex portion of a mold, and then pressed into the shape determined by the mold. The shape of the mold and eventual shape of the top component 102 may be selected based on various factors, but the resulting convex shape allows the needles to be received through a thick layer of anchoring filling 132 and better retain their position during use. After being removed from the mold, the top component 102 is laid on a rack to dry and generally retains the shape given to it by the mold.

By forming the top component 102 using the wet-molding process, the top component 102 may better retain its shape during use, and avoids compressing the anchoring filling 132 unintentionally, which may affect the removal and insertion of needles. In particular, because the top component 102 is formed with a convex shape, the anchoring filling 132 can fill the interior cavity 136 without being compressed by the top component 102.

With reference again to FIG. 9, after operation 202, the method 200 may proceed to operation 204. In operation 204, the unformed contoured substrate 130 or member is heated. In embodiments where the contoured substrate 130 is a thermoformable plastic, the material is heated until it becomes pliable, such as at a temperature of around 350 degrees for approximately one minute Once the contoured substrate 130 has been heated, the method 200 may proceed to operation 206. In operation 206, the heated or pliable contoured member or substrate 130 is formed into a desired shape. For example, the heated contoured member 130, while still hot, may be a laid onto a convex surface. After the contoured member 130 has taken on the desired shape or mold, the method 200 may proceed to operation 208 and the contoured members is cooled for a period of time, such as 20 seconds, so the contoured member 130 will conform to the shape of that surface or mold.

After the contoured member 130 has cooled, the method 200 may proceed to operation 210. In operation 210, the contoured member 130 is secured to the bottom component 116. For example, the contoured stiffening piece may be glued to the interior surface 134 of the bottom component 116 of the pad 100 to help prevent the contoured member 130 from shifting position. Alternatively, the contoured member 130 may be sewn, laced, riveted, or applied with any other suitable type of hardware or connector. The contoured member 130 may be also laid into the interior without adhesive and held in place by the anchoring filling 132.

With continued reference to FIG. 9, once the contoured member 130 is connected to the bottom component 116, or in instances where the contoured member 130 is formed internally with the bottom component 116, or when the bottom component 116 is made of a material that can shaped and therefore needs no additional contoured member 130, the method 200 may proceed to operation 212. In operation 212, the top and bottom components 102, 116 are secured together. For example, with reference to FIGS. 3 and 4, a seal 108 is formed, e.g., through sewing, lacing, adhesive, metal or plastic fasteners, or a combination of different fastening techniques or devices. In one embodiment, adhesive and stitching may be used to secure the top component 102 and the bottom component 116 together. The seal 108 between the two components 102, 116 defines the shape of the interior cavity 136 for receiving the filling material and as such may be modified as desired. In one embodiment, the seal 108 will be positioned just inwards from the outer edges 110, 120 of the top and bottom components 102, 116. In these examples, the outer edges 110, 120 may be formed with a selvedge that creates a flat area around and outside of the interior cavity 136 where the adhesive and stitching can be applied. In operation 212, the seal 108 may be only partially applied to leave access to the interior cavity 136 so the anchoring filling 132 may be inserted into the interior cavity 136. For example, one side of the pad 100 may be left unsealed, or the like.

After operation 212, the method 200 may proceed to operation 214. In operation 214, the anchoring filling 132 is positioned within the interior cavity 136. For example, the anchoring filling 132 may be inserted into the cavity 136 though an access hole defined between the two components 102, 116. Alternatively, the anchoring filing 132 may be inserted in another manner, e.g., through a resealable flap, before the bottom component 116 is attached to the top component 102, or the like.

With reference to FIG. 9, after the anchoring filling 132 has been inserted into the pad 100, the method 200 may proceed to operation 216. In operation 216, the seal 108 is completed to secure the top component 102 to the bottom component 116. For example, a template may be used to mark the location of desired stitches and the top and bottom components 102, 116 may be sealed together all the way around their perimeters. It should be noted that depending on the method used to insert the anchoring filing 132, this operation may be omitted. In operation 216, the final shape of the pad 100 may also be determined and any excess selvedge material on the top or bottom components 102, 116 may be removed, e.g., via scissors, a knife, or the like.

After operation 216, the method 200 may proceed to operation 218. In operation 218, the belt connectors 112*a*, 112*b* are attached to the pad 100. In one example, with reference to FIG. 6, the tabs 124*a*, 124*b* or tails of material of the top component 102 are folded around a portion of the belt connectors 112*a*, 112*b*, and the fasteners 114*a*, 114*b* extend through the top surface 104 of the top component 102, the tabs 124*a*, 124*b*, and the bottom component 116 to secure the free ends of the tabs 124*a*, 124*b*, forming a loop through which the belt connectors are attached at each side of the pad. It should be noted that in other embodiments the belt connectors 112*a*, 112*b* may be connected to the pad 100 in various other manners and the above description is meant as illustrative only. In the embodiment shown in FIG. 3, the tabs are folded into place and riveted; the D-rings have a screw post and are inserted into the tab later. This allows different length belts for sizes (e.g., small, medium, large, etc.), to be attached and/or to replace a damaged or defective belt should user require. In some embodiments the tab may be folded around a fixed D-ring, without a removable post.

After the belt connectors 112*a*, 112*b* are attached, the method 200 may proceed to an end state 220 and terminate. It should be noted that additional finalizing operations may be performed on the pad 100 after it is assembled and/or during the assembly process. For example, the outer edges 110, 120 may be sanded, coated with an edge sealer, and/or buffed, and the pad is cleaned and polished.

A method of using the knitting pad 100 for knitting will now be discussed. With reference to FIG. 2, a user, such as a knitter, will secure the knitting pad 100 to his or her body at a desired location. For example, the belt may include a prong buckle attached to the end of the belt section connected to the right of the pad. The belt section connected to the left of the pad has a plurality of holes (e.g., 7 to 9 holes) into which the buckle prong can be inserted, which allows for quick attachment or release. In wear, the buckle may be positioned at the knitter's left front. An additional piece of hardware can be mounted on the belt attached to the right side of the pad that allows the size to be further adjusted, and which in wear is on the knitter's right back. For example, this component could be a "slider", a rectangular, three bar piece of hardware through which the end of the belt first passes through the slider, then through the D-ring and is then folded back on itself and passed through the slider again, which allows the circumference of the belt to be further adjusted. This function could also be performed by any other device that allowed a similar adjustment, such as snaps, or studs inserted into apertures in the belt. This additional adjustment device permits the user to change the size of the belt to accommodate seasonal clothing differences, or a radical change in weight. In other embodiments, the pad may have a casing on the lower piece 116 through which the user could insert a belt, or the knitter may thread a belt through the belt connectors 112*a*, 112*b* and then attach the belt around his or her waist. In some embodiments, the belt may be riveted directly to the pad and have a buckle at one end and holes on the other to receive the buckle prong, or it may be a chain with a hook closure allowing for adjustment in size.

Alternatively, the pad may be fitted with a specialized belt clip so it can be attached to a user's belt, waistband, or pocket. In one example, the knitter most commonly fastens the belt at his or her waist or hip with the pad 100 positioned at the right front side; some knitters may prefer to fasten it at the left front side. The desired location for the pad 100, both horizontally and vertically, is determined by several factors, such as, but not limited to, the length of the needle, the knitter's eyesight, a comfortable position for the arms, and the need to have the active portion of the work centered on the body.

The knitting process that uses the knitting pad 100 is done with double-point needles (having an identical point at both ends). To begin, a set of stitches is placed on one of the needles using a continuous supply of yarn. A second needle is taken up and one or more inches of one of the tips is inserted into one of the needle reception apertures 106 formed on the needle reception surface 104 on the top of the pad 100. The opposite tip is pointed up and to the left.

The needle reception aperture 106 used to support the needle may typically be determined based on various factors and preferences by the knitter, for example, the angle at which the needle is inserted, the knitter's eyesight, comfortable position of the arms, and the need to center the opposite tip on the body. In embodiments where the anchoring filling 132 is horsehair stuffing, due to the characteristics of the horsehair, the angle of the needle is difficult to change unless the needle is removed and reinserted. This helps to keep the needle oriented as desired by the user, even as the needle experiences forces due to the knitting process.

The knitter typically will hold the needle bearing the stitches in the left hand, and carries the yarn connected to the stitches in the right hand. The tips of the two needles are brought together and each stitch is manipulated in turn to pull a loop of the yarn through an existing stitch, thus forming a new one. The new stitch is retained on the right needle and the original stitch is dropped below it into the growing fabric. When all of the original stitches have been worked, the left needle will be empty and all of the new stitches will be on the right needle.

To continue, the right needle bearing the new stitches is withdrawn from the pad 100 and transferred to the left hand; the now empty left needle is transferred to the right hand and inserted into one of the needle reception apertures 106 of the pad 100. The knitter then proceeds to create the next row of stitches, in the same way as described above.

Because the pad 100 firmly maintains the right needle at the optimum angle, it is not necessary to hold the needle with the right hand, as is required for every other method of knitting. Instead, the hand is positioned above the right needle with the thumb and middle finger resting on top of it, a few inches back from the tip. These fingers serve as a fulcrum for the motions needed for knitting; the other fingers are used to tension the yarn and wrap it around the right needle when making each new stitch. This hand position makes it possible to use very small movements to work each stitch, and the resulting economy of motion reduces fatigue, allows the knitter to achieve greater speed, and produces a fabric with exceptionally even tension.

Furthermore, with the needle held firmly in position at an ideal angle for the individual, the arms and shoulders can be held in the most comfortable position and the risk of repetitive motion injury or stiffness in the neck and shoulder is reduced.

During the process of knitting, a certain amount of downward force can be applied to the tip of the right needle. During the process of exchanging needles, a certain amount of lateral force is applied to the pad 100. Due to the novel contour of the bottom of the pad 100, which is curved in the horizontal dimension, but flat in the vertical dimension, it stays in whatever position the knitter originally selected in spite of the forces exerted on it when a needle is inserted or removed and as each stitch is formed. Therefore, there is no need to stop and reposition the pad 100, which reduces the amount of effort and time spent on any project.

CONCLUSION

The foregoing description has broad application. For example, while examples disclosed herein may focus on knitting applications, it should be appreciated that the concepts disclosed herein may equally apply to other craft applications such as crocheting or the like, or to any situation where an object needs to be temporarily attached to the body and held in a fixed position. Similarly, although the knitting pad may be discussed with respect to attachment to a user's midsection, the devices and techniques disclosed herein are equally applicable to other attachment locations on the body on the body, as determined by the user. Accordingly, the discussion of any embodiment is meant only to be exemplary and is not intended to suggest that the scope of the disclosure, including the claims, is limited to these examples.

All directional references (e.g., proximal, distal, upper, lower, upward, downward, left, right, lateral, longitudinal, front, back, top, bottom, above, below, vertical, horizontal, radial, axial, clockwise, and counterclockwise) are used only for identification purposes to aid the reader's understanding of the present disclosure, and do not create limitations, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in a fixed relation to each other. The exemplary drawings are for purposes of illustration only and the dimensions, positions, order, and relative sizes reflected in the drawings attached hereto may vary.

What is claimed is:

1. A wearable needle support comprising:

an anchoring filling configured to support a needle in a desired position;

a needle reception material covering the anchoring filling; and a contoured substrate opposite of the needle reception material and operably connected to the needle reception material, wherein the contoured substrate is concavely curved along at least one axis, the contoured substrate comprising:

an outer material having an outer surface and an interior surface; and a rigid member coupled to the interior surface of the outer material; wherein the outer surface of the outer material and an outer surface of the needle reception material define, at least in part, an exterior of the wearable needle support; and the rigid member defines the concavely curved shape of the contoured substrate.

2. The wearable needle support of claim 1, wherein the needle reception material comprises a plurality of needle reception apertures sized to receive a needle therethrough.

3. The wearable needle support of claim 1, wherein the anchoring filling comprises horsehair and the rigid member is plastic or metal.

4. The wearable needle support of claim 1, further comprising a belt operably connected to at least one of the needle reception material or the contoured substrate.

5. The wearable needle support of claim 1, wherein the needle reception material is convexly curved away from rigid member.

6. The wearable needle support of claim 1, wherein the contoured substrate conforms to a curvature of a user's torso.

7. The wearable needle support of claim 1, wherein the rigid member and an interior surface of the needle reception material define, at least in part, an interior cavity of the wearable needle support.

8. The wearable needle support of claim 1, wherein the contoured substrate is concavely curved toward the needle reception material.

9. The wearable needle support of claim 1, wherein the needle reception material is rigidly and permanently shaped into a convex contour.

10. A method of making a knitting assistance accessory, comprising:

creating a stiffening member by forming a shapeable material from an initial shape into a contoured shape;

attaching a bottom material to the stiffening member;

attaching a needle reception material to the bottom material to define a cavity between the stiffening member and the needle reception material; and stuffing an anchoring material into the cavity.

11. The method of claim 10, wherein creating the stiffening member comprises:

placing the shapeable material over a shaping mold; and heating the shapeable material until the shapeable material deforms to the shaping mold.

12. The method of claim 10, further comprising connecting a body attachment component to at least one of the bottom material or the needle reception material.

13. The method of claim 12, wherein the body attachment component is at least one of a belt, a strap or a clip.

14. The method of claim 10, wherein the contoured shape is a concavely curved shape and the shapeable material is a thermoformable material.

15. The method of claim 10, wherein prior to attaching the second material to the bottom material, the method comprises permanently shaping the needle reception material into a convex shape.

16. A support device for knitting connectable to the body of a user comprising:

a top component;

a bottom component operatively connected to the top component to define a cavity therebetween;

a needle support member received within the cavity; and a stability component received within the cavity and coupled to the bottom component, wherein the stability component is concavely shaped to match a portion of the body of the user where the support accessory is connected and is sufficiently rigid to maintain the concave shape.

17. The support device of claim 16, wherein the stability component comprises a thermoformable plastic.

18. The support device of claim 16, wherein the top component includes a plurality of apertures.

19. The support device of claim 18, wherein the apertures are sized to receive a knitting needle.

20. The support device of claim 16, wherein the needle support member comprises a stuffing.

21. The support device of claim 16, wherein a shape of the bottom component is determined by the shape of the rigid member.

* * * * *